US010548439B2

(12) United States Patent
Gagnon et al.

(10) Patent No.: US 10,548,439 B2
(45) Date of Patent: Feb. 4, 2020

(54) SANITIZING HAND DRYER

(75) Inventors: Denis Gagnon, Wilbraham, MA (US); William Gagnon, Springfield, MA (US); Richard Eckhardt, Arlington, MA (US)

(73) Assignee: Excel Dryer, Inc., East Longmeadow, MA (US)

( * ) Notice: Subject to any disclaimer, the term of this patent is extended or adjusted under 35 U.S.C. 154(b) by 686 days.

(21) Appl. No.: 13/442,600

(22) Filed: Apr. 9, 2012

(65) Prior Publication Data

US 2013/0031799 A1 Feb. 7, 2013

Related U.S. Application Data

(60) Provisional application No. 61/472,972, filed on Apr. 7, 2011.

(51) Int. Cl.
*F26B 3/00* (2006.01)
*A47K 10/48* (2006.01)

(52) U.S. Cl.
CPC ..... *A47K 10/48* (2013.01)

(58) Field of Classification Search
CPC ..... A47K 10/48; A47K 2210/00
USPC ..... 34/61, 381, 380, 68, 74, 60, 266, 267, 34/275, 283, 96, 101, 480, 417, 311
See application file for complete search history.

(56) References Cited

U.S. PATENT DOCUMENTS 2,577,809 A 12/1951 Reeves et al.
3,584,766 A 6/1971 Hart et al.
3,704,572 A 12/1972 Gourdine et al.
3,873,835 A 3/1975 Ignatjev
3,948,601 A 4/1976 Fraser et al.
4,087,925 A * 5/1978 Bienek ..... A47K 10/48 250/432 R
4,383,377 A 5/1983 Crafton
(Continued)

FOREIGN PATENT DOCUMENTS

CN 2517375 10/2002
CN 201164424 12/2008
(Continued)

OTHER PUBLICATIONS

Haynes Repair Manual, Jeep Grand Cherokee 1993 thru 2004, Haynes Publishing, p. 1-24.*
(Continued)

*Primary Examiner* — John P McCormack
(74) *Attorney, Agent, or Firm* — O'Shea Getz P.C.

(57) ABSTRACT

A sanitizing hand dryer comprises a dryer housing having an inlet air channel and an outlet air channel. A blower draws air into the dryer housing through the inlet air channel, and directs the air out of the dryer housing through the outlet air channel A sanitizing system sanitizes the air within the inlet air channel and the air within the outlet air channel, wherein the sanitizing system within the inlet air channel includes at least one of a first air filter, a first ozone generator, a first sanitizing light source, a first photocatalytic oxidation system, a first ion generator, and a first electrostatic precipitator. The sanitizing system within the outlet air channel includes at least one of a second air filter, a second ozone generator, a second sanitizing light source, a second photocatalytic oxidation system, a second ion generator, and a second electrostatic precipitator.

12 Claims, 11 Drawing Sheets

(56) References Cited

U.S. PATENT DOCUMENTS

| | | | | |
|---|---|---|---|---|
| 4,596,921 | A | 6/1986 | Hersch et al. | |
| 4,625,119 | A | 11/1986 | Murdock, III | |
| 4,729,057 | A | 3/1988 | Halleck | |
| 4,794,225 | A | 12/1988 | Maese | |
| 4,831,685 | A * | 5/1989 | Bosyj | A47L 5/24 15/344 |
| 4,931,261 | A | 6/1990 | Jacob | |
| 5,200,146 | A | 4/1993 | Goodman | |
| 5,459,944 | A | 10/1995 | Tatsutani et al. | |
| 5,560,120 | A | 10/1996 | Swanson et al. | |
| 5,828,063 | A | 10/1998 | Koster et al. | |
| 5,874,166 | A | 2/1999 | Chu et al. | |
| 6,077,334 | A | 6/2000 | Joannou | |
| 6,130,815 | A | 10/2000 | Pitel et al. | |
| 6,640,049 | B1 * | 10/2003 | Lee et al. | 392/385 |
| 6,645,435 | B2 | 11/2003 | Dawson et al. | |
| 6,705,428 | B2 | 3/2004 | Kudernatsch | |
| 6,717,414 | B1 | 4/2004 | Rodrigo et al. | |
| 6,730,238 | B2 | 5/2004 | Li et al. | |
| 6,785,114 | B2 | 8/2004 | Gorczyca et al. | |
| 6,874,697 | B2 | 4/2005 | Callueng | |
| 7,039,301 | B1 | 5/2006 | Aisenberg et al. | |
| 7,878,371 | B2 | 2/2011 | Sassoon | |
| 7,946,055 | B2 | 5/2011 | Churchill et al. | |
| 7,989,779 | B1 | 8/2011 | Ray et al. | |
| 8,037,691 | B2 | 10/2011 | Commaret et al. | |
| 8,064,756 | B2 | 11/2011 | Liu | |
| D661,023 | S | 5/2012 | Liu et al. | |
| 2004/0026530 | A1 | 2/2004 | Callueng | |
| 2006/0244386 | A1 | 11/2006 | Hooke et al. | |
| 2006/0272170 | A1 * | 12/2006 | Holmes | 34/275 |
| 2006/0272673 | A1 | 12/2006 | Kurunczi | |
| 2008/0253754 | A1 | 10/2008 | Rubin | |
| 2009/0119942 | A1 | 5/2009 | Aisenberg et al. | |
| 2010/0192399 | A1 * | 8/2010 | Sawabe | A47K 10/48 34/95 |
| 2010/0247389 | A1 | 9/2010 | Abate | |
| 2010/0254853 | A1 | 10/2010 | Lee et al. | |
| 2011/0023319 | A1 * | 2/2011 | Fukaya et al. | 34/202 |
| 2011/0116967 | A1 | 5/2011 | Roy et al. | |
| 2011/0277342 | A1 | 11/2011 | Ishii et al. | |
| 2012/0200982 | A1 | 8/2012 | Partridge | |
| 2012/0285033 | A1 | 11/2012 | Hsu | |

FOREIGN PATENT DOCUMENTS

| | | |
|---|---|---|
| EP | 2327327 | 6/2011 |
| GB | 2358350 | 7/2001 |
| GB | 2380676 | 4/2003 |
| JP | 2011019606 | 2/2011 |
| WO | 2007067924 | 6/2007 |

OTHER PUBLICATIONS

"Machinery Industry Standard of the People's Republic of China", China Academy of Machinery Science & Technology, p. 1-7, Oct. 1992.

Chinese office action for CN2012800284110.6 dated Mar. 29, 2016.

* cited by examiner

SANITIZING HAND DRYER

CROSS REFERENCE TO RELATED APPLICATIONS

This application claims priority from the provisional application designated Ser. No. 61/472,972 filed Apr. 7, 2011 and entitled "Sanitizing Hand Dryer", which is hereby incorporated by reference.

FIELD OF THE INVENTION

This disclosure relates generally to hand dryers and, more particularly, to a sanitizing hand dryer that may be used in a restroom such as for example a public restroom.

BACKGROUND OF THE INVENTION

High speed hand dyers are disclosed in U.S. Pat. Nos. 6,038,786 and 7,039,301 both assigned to the assignee of the present invention, Excel Dryer, Inc (www.exceldryer.com). In addition, high speed hand dryers are available from the assignee of the present invention under its XLERATOR® line of hand dryers. XLERATOR® hand dryers have significantly reduced the time it takes a user to dry his hands.

There is a need for a sanitizing hand dryer.

SUMMARY OF THE INVENTION

According to an aspect of the invention, a sanitizing hand dryer includes a dryer housing having an air inlet and an exit nozzle; an air filter assembly having a coarse filter and a high-efficiency particulate air filter that receives air from the air inlet and provides filtered air; a blower that draws filtered air and accelerates the filtered air to provide high speed filtered air; and an ion generator that includes a wire grid through which the filtered air passes to provide sanitized air to the exit nozzle.

According to another aspect, a sanitizing hand dryer comprises a dryer housing having an air inlet and an exit nozzle, wherein the exit nozzle is perpendicular to an axial direction of the air inlet; a filter housing that is secured to the dryer housing about the air inlet; an air filter assembly that seats with a friction fit within the filter housing, wherein the air filter assembly comprises a serially configured coarse filter and a high-efficiency particulate air filter that receives ambient air and provides filtered air; a blower that draws the filtered air and accelerates the filtered air to provide high speed filtered air; and an ion generator that includes a high voltage wire grid through which the high speed filtered air passes to provide high speed sanitized air to the exit nozzle.

According to yet another aspect, a sanitizing hand dryer comprises a dryer housing having an inlet air channel and an outlet air channel; a blower that draws air into the dryer housing through the inlet air channel, and directs the air out of the dryer housing through the outlet air channel; and a sanitizing system that sanitizes the air within the inlet air channel and the air within the outlet air channel, wherein the sanitizing system within the inlet air channel includes at least one of a first air filter, a first ozone generator, a first sanitizing light source, a first photocatalytic oxidation system, a first ion generator, and a first electrostatic precipitator, and wherein the sanitizing system within the outlet air channel includes at least one of a second air filter, a second ozone generator, a second sanitizing light source, a second photocatalytic oxidation system, a second ion generator, and a second electrostatic precipitator.

These and other objects, features and advantages of the present invention will become apparent in light of the following detailed description of preferred embodiments thereof, as illustrated in the accompanying drawings.

DETAILED DESCRIPTION

Figure 1:
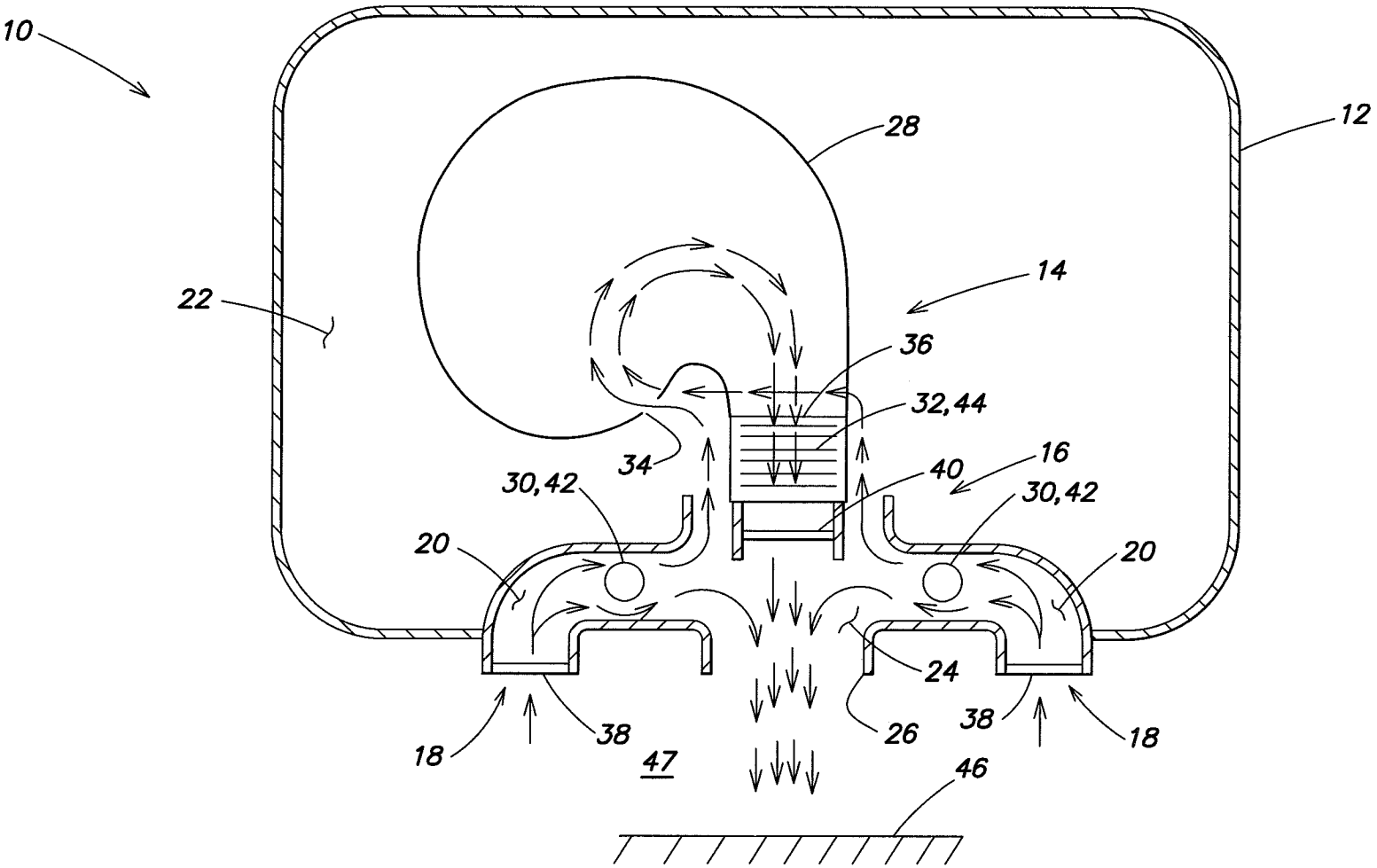
FIG. 1 is a pictorial illustration of a sanitizing hand dryer.

FIG. 1 illustrates a sanitizing hand dryer 10. The hand dryer 10 includes a dryer housing 12, a drying system 14 and a purification and sanitization system 16.

The dryer housing 12 has one or more air inlets 18, one or more inlet air channels 20, an internal chamber 22, an outlet air channel 24, and an exit nozzle 26. Each inlet air channel 20 extends from a respective one of the air inlets 18 to the internal chamber 22. The outlet air channel 24 extends to the exit nozzle 26. The outlet air channel 24 is fluidly connected to each of the inlet air channels 20.

The drying system 14 includes a blower 28 and one or more heaters 30 and 32. The blower 28 may be configured as, for example, a fan-type blower, a vacuum pump blower, or a multistage blower. The blower 28 has a blower inlet 34 and a blower outlet 36. The blower inlet 34 is fluidly connected to the air inlets 18 through the inlet air channels 20 and the internal chamber 22. The blower outlet 36 is fluidly connected to the exit nozzle 26 through the outlet air channel 24. The heaters may include one or more inlet heaters 30 and an outlet heater 32. Each inlet heater 30 is arranged in a respective one of the inlet air channels 20. The outlet heater 32 is arranged between the blower outlet 36 and the outlet air channel 24. An example of such a hand drying system is disclosed in U.S. Pat. No. 7,039,301, which is hereby incorporated by reference in its entirety. An alternative example of a suitable hand drying system is disclosed in U.S. Pat. No. 6,038,786, which is hereby incorporated by reference in its entirety.

The sanitization system 16 may include one or more air filters 38 and 40 and one or more air sanitizers 42 and 44 (also sometimes referred to as "air purifiers"). The air filters may include one or more inlet air filters 38 and an outlet air filter 40. Each air filter 38, 40 may be configured as, for example, a charcoal air filter, an activated carbon air filter, a micro glass fiber fleece air filter, a high efficiency particulate air (HEPA) filter, an electrostatic air filter, or a combination thereof. Each inlet air filter 38 is, for example, removeably and replaceably connected to a respective one of the air inlets 18. The outlet air filter 40 is connected between the blower outlet 36 and the outlet air channel 24.

The air sanitizers may include one or more inlet air sanitizers 42 and an outlet air sanitizer 44. For ease of illustration, each air sanitizer 42, 44 and a respective one of the heaters 30, 32 are shown as a single multi-functional sanitization/heating device. One or more of the air sanitizers and heaters, however, can be configured as separate devices in alternative embodiments. Each air sanitizer 42, 44 may be configured as, for example, an ozone generator, a sanitizing light source (e.g., an ultraviolet light bulb), a photocatalytic oxidation (PCO) system, an ion generator (e.g., an ionizer), an electrostatic precipitator, or a combination thereof. Each inlet air sanitizer 42 is arranged within a respective one of the inlet air channels 20, for example, between the air inlet 18 and the outlet air channel 24. The outlet air sanitizer 44 is arranged within the outlet air channel 24.

During operation, the blower 28 draws air into the dryer housing 12 through the air inlets 18. The air drawn into the air inlets 18 is hereinafter referred to as "inlet air". The inlet air filters 38 remove particulates (e.g., dirt and bacteria) from the inlet air as the air travels to the inlet heaters 30 and inlet air sanitizers 42. The inlet heaters 30 preheat the inlet air. The inlet air sanitizers 42 kill and/or neutralize bacteria, germs, viruses, etc. and/or other harmful substances in the inlet air. The preheated and sanitized inlet air travels through the inlet air channels 20 to the internal chamber 22, and is drawn into the blower 28 through the blower inlet 34. The blower 28 accelerates the inlet air, and directs the air through the blower outlet 36 towards the outlet heater 32 and the outlet air sanitizer 44. The air directed out of the blower outlet 36 is hereinafter referred to as "outlet air". The outlet air sanitizer 44 also kills and/or neutralizes bacteria, genus, viruses, etc. and/or other harmful substances in the outlet air. The heated and sanitized outlet air travels through the outlet filter 40, which removes particulates (e.g., dirt and bacteria) from the air, and into the outlet air channel 24. A portion of the heated and sanitized inlet air is combined with the heated and sanitized outlet air in the outlet air channel 24, and is directed out of the dryer housing 12 through the exit nozzle 26 as a heated and sanitized stream of air. The stream of air may subsequently be used to dry a surface 46 of an object or body part (e.g., human hands) placed proximate (e.g., beneath) the exit nozzle 26.

In some embodiments, the stream of air may include a sanitization substance (e.g., ozone) that may kill and/or neutralize bacteria, germs, viruses, etc. and/or other harmful substances on the surface 46 being dried and/or in ambient air 47 surrounding the surface 46 and/or the dryer housing 12. The sanitization substance may be generated or provided by one or more of the air sanitizers 42 and/or 44.

In some embodiments, the stream of air may be ionized such that the air may kill and/or neutralize bacteria, germs, viruses, etc. and/or other harmful substances on the surface 46 being dried and/or in the ambient air 47. The stream of air may be ionized by one or more of the air sanitizers 42 and/or 44.

In embodiments where the outlet air sanitizer 44 includes a sanitizing light source, sanitizing light (e.g., ultraviolet light) generated by the outlet air sanitizer 44 may be directed onto the surface 46 being dried. The sanitizing light may kill and/or neutralize bacteria, germs, viruses, etc. and/or other harmful substances on the surface 46 and/or in the ambient air 47 while the surface 46 is being dried. Alternatively, the sanitizing light may be turned on after the surface 46 is dried.

In some embodiments, a germicidal sprayer (not shown) may be arranged with the hand dryer to sanitize the surface 46. The germicidal sprayer may be configured to spray a germicide (e.g., sanitizer) onto the surface 46 when the surface 46 is proximate (e.g., beneath) the exit nozzle 26, or alternatively proximate to another part of the dryer housing 12.

In an alternate embodiment, the outlet air channel 24 can be fluidly isolated from each inlet air channel 20 by, for example, a wall (not shown).

In another alternate embodiment, the drying system 14 does not include the heaters 30 and 32.

Figure 2:
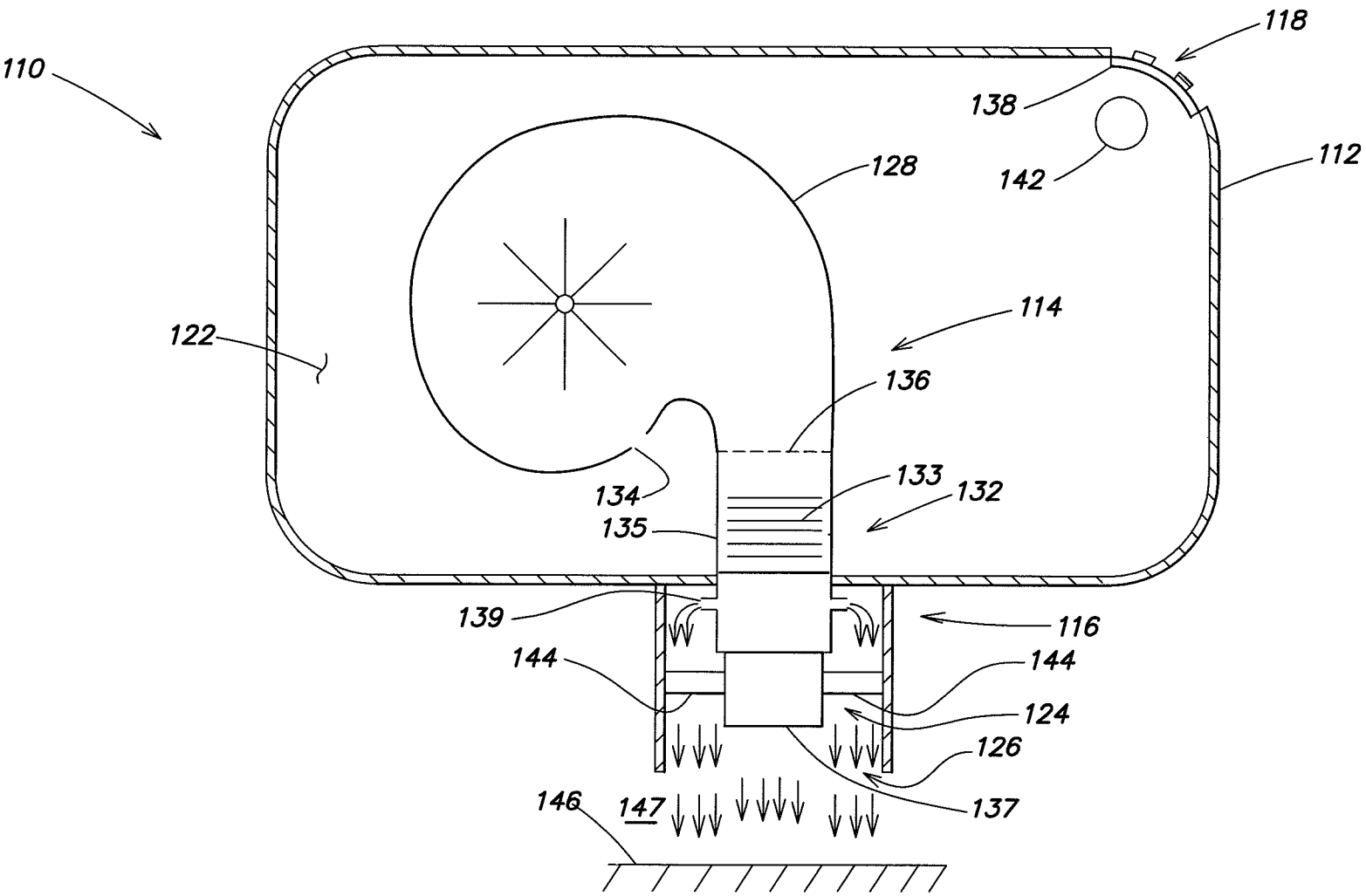
FIG. 2 is a pictorial illustration of another sanitizing hand dryer.

FIG. 2 illustrates another embodiment of a sanitizing hand dryer 110. The hand dryer 110 includes a dryer housing 112, a drying system 114 and a purification and sanitization system 116.

The dryer housing 112 has an inlet grate 118, an internal chamber 122, an outlet air channel 124 and an exit nozzle 126. The inlet grate 118 has a plurality of air inlets that are fluidly connected to the internal chamber 122. The outlet air channel 124 extends to the exit nozzle 126.

The drying system 114 includes a blower 128 and a heater 132. The blower 128 has a blower inlet 134 and a blower outlet 136. The blower inlet 134 is fluidly connected to the inlet grate 118 through the internal chamber 122. The blower outlet 136 is fluidly connected to the exit nozzle 126 through the heater 132 and the outlet air channel 124. The heater 132 includes a heating element 133 disposed within a heater housing 135 (e.g., a tubular heater housing). The heater housing 135 extends from the blower outlet 136 to a primary heater outlet 137. The heater housing 135 includes one or more secondary heater outlets 139. The primary and the secondary heater outlets 137 and 139 are arranged to provide a plurality of substantially parallel streams of air within the outlet air channel 124.

The sanitization system 116 may include an air filter 138 and one or more air sanitizers 142 and 144. The air filter 138 may be configured as, for example, a charcoal air filter, an activated carbon air filter, a micro glass fiber fleece air filter, a high efficiency particulate air (HEPA) filter, an electrostatic air filter, or a combination thereof. The air filter 138 is connected to the inlet grate 118, for example, within the internal chamber 122.

The air sanitizers may include an inlet air sanitizer 142 and/or one or more outlet air sanitizers 144. Each air sanitizer 142, 144 may be configured as, for example, an ozone generator, a sanitizing light source (e.g., an ultraviolet light bulb), a photocatalytic oxidation (PCO) system, an ion generator (e.g., an ionizer), an electrostatic precipitator, or a combination thereof. The inlet air sanitizer 142 is configured within the internal chamber 122 to kill and/or neutralize bacteria, germs, viruses, etc. and/or other harmful substances in inlet air drawn into the dryer housing 112. The outlet air sanitizers 144 are arranged in the outlet air channel 124. Each outlet air sanitizer 144 is configured to kill and/or neutralize bacteria, germs, viruses, etc. and/or other harmful substances in the secondary streams of air provided by the secondary heater outlets 139. Each outlet air sanitizer 144 may also be configured to ionize the secondary streams of air and/or add a sanitization substance to the secondary streams of air. In embodiments where each outlet air sanitizer 144 includes a sanitizing light source, the outlet air sanitizers 144 may be arranged within the outlet air channel 124 such that sanitizing light (e.g., ultraviolet light) is directed onto the surface 146 being dried.

The ionized stream of air, the sanitization substance and/or the sanitizing light may be used, as indicated above, to kill and/or neutralize bacteria, germs, viruses, etc. and/or other harmful substances on the surface 146 being dried and/or in ambient air 147 surrounding the surface 146 and/or the dryer housing 112.

Figure 3:
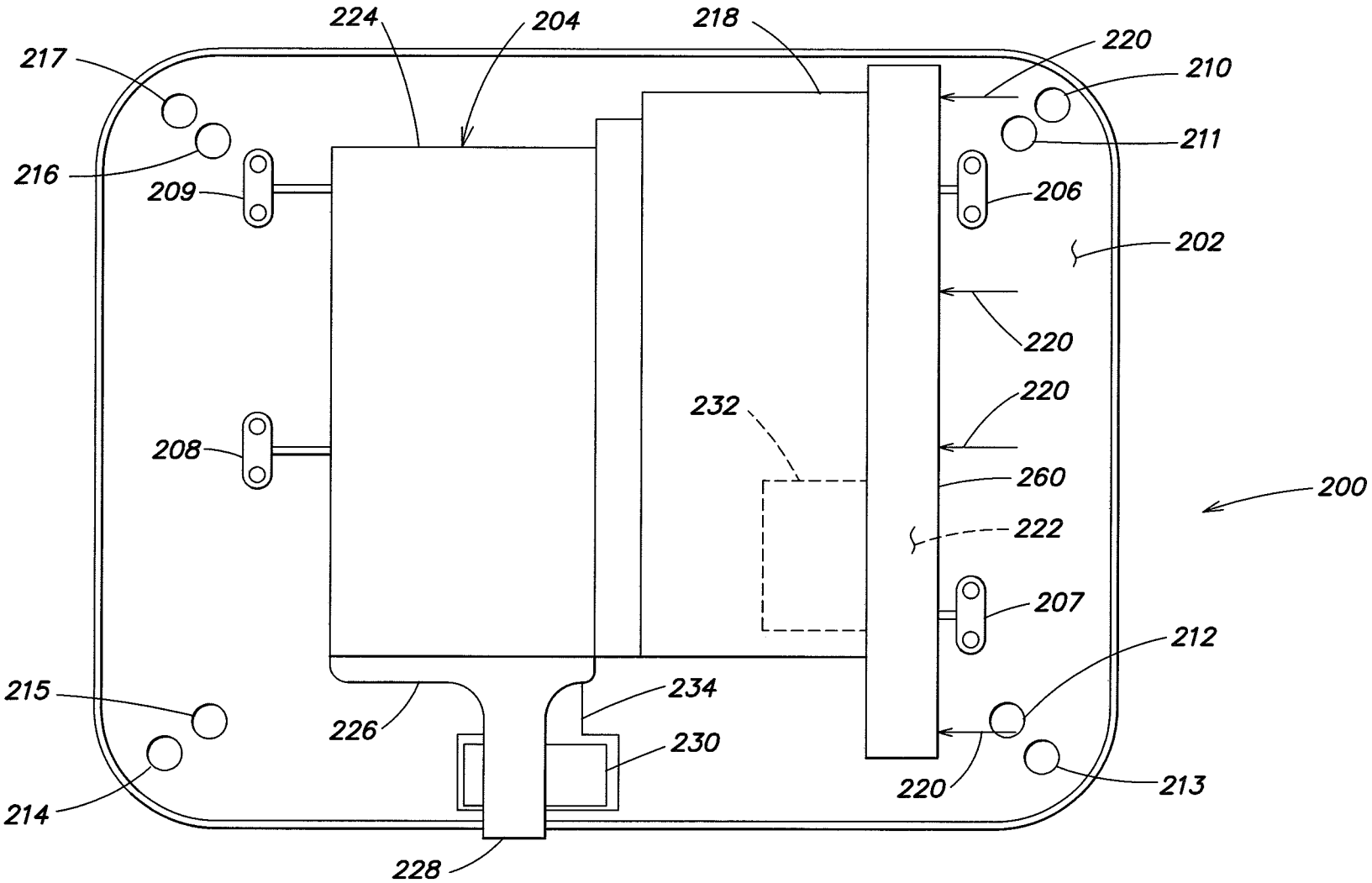
FIG. 3 is a simplified top view illustration of yet another sanitizing hand dryer that includes a filter housing.

FIG. 3 is a simplified top view illustration of a hand dryer assembly 200, with its cover (not shown) removed. The assembly 200 includes a mounting plate 202, that for example facilitates securing the assembly 200 to a wall. The assembly 200 also includes a hand dryer 204 that is secured (e.g., removably and replaceably with screws) to the mounting plate 202 via a plurality of mounting posts 206-209, such that a bottom surface of the dryer 204 rests above the surface of the mounting plate 202 (e.g., separate by about ⅛"). The mounting plate 202 may be secured to the wall or other surface via a plurality of mounting holes 210-217.

The dryer 204 includes a housing (e.g., plastic) that contains a blower motor assembly 218 that draws air, shown by flow arrows 220, into an air filter unit 222. The blower motor assembly 218 includes an electric motor 224 that drives a shaft (not shown) to rotate an impellor (not shown). The motor may be a thermally protected, series commutated, through-flow discharge vacuum motor/blower (e.g., ⅝ hp/20,000 rpm) which provides air velocity of about 19,000 linear feet per minute (lfm) at the outlet and about 16,000 lfm at the hands of a user about four inches (102 mm) below the outlet. The forced air exiting the blower motor assembly passes a plurality of heating coils to heat the air, such that the air is more comfortable on the hands of a user. The forced warmed air enters a discharge nozzle assembly 226 that provides the warm forced air onto the hands of a user via an outlet 228. The hand dryer assembly 200 also includes a sensor 230 (e.g., an infrared optical sensor) that automatically detects the presence of a user, and provides a signal to a controller 232 that turns on the motor 224 and the heating coil to provide the warmed forced air via the discharge nozzle assembly 226. The controller will also turn on an ion generator to be discussed hereinbelow. The sensor 230 is removably and replaceably secured to the hand dryer 204 via a bracket 234. The controller 232 may include an automatic shut-off in the even the hands have not been detected as being removed within a certain time period (e.g., 35 seconds)

Figure 4:
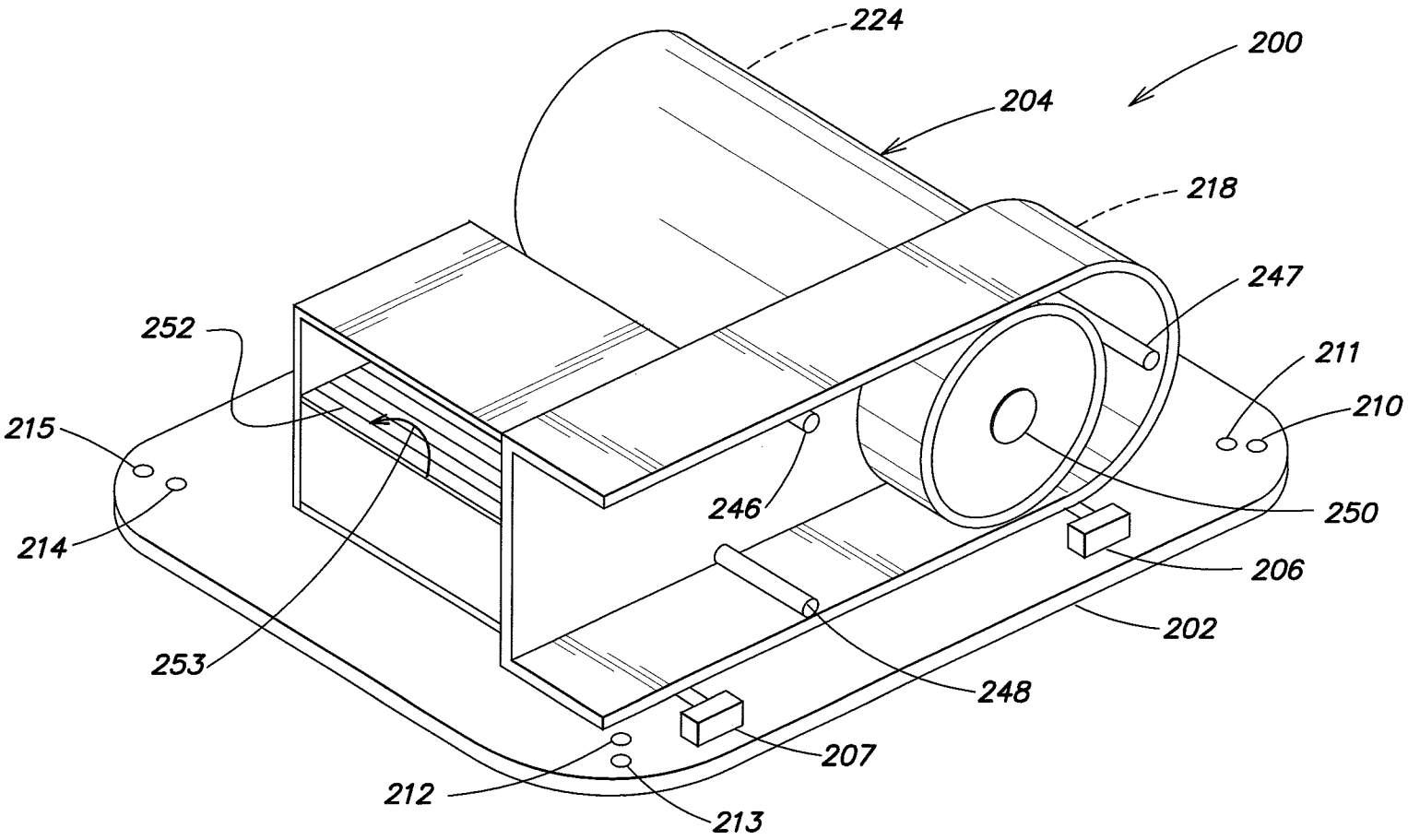
FIG. 4 is a perspective view of the hand dryer illustrated in FIG. 3 with the filter housing removed.

FIG. 4 is a perspective view of the hand dryer 204 illustrated in FIG. 3 with the filter assembly 222, the discharge nozzle assembly 226 and the sensor 230 removed for ease of illustration. The filter assembly may be removably and replaceably secured to the hand dryer via a plurality of threaded bores 246-248. The blower motor assembly 218 includes an impellor air inlet 250 that is coaxial with the shaft driven by the electric motor 224, and receives filtered air from the filter unit 222. Since the discharge nozzle assembly 226 is removed from the hand dryer 204 illustrated in FIG. 4, the perspective view illustrates a heating element 252 that comprises a plurality of coils that warm the forced air 253. In one embodiment the heating element may 252 be sized about 970 watts and have coils constructed of Nichrome wire. The heating element may include an automatic resetting thermostat that opens to turn off power to the heating element when the blower is not operating and close when the blower is operating. The heating coil may provide a discharge air temperature of up to about 135 deg. F. (57 deg. C.) at a 72 deg. F. (22 deg. C.) ambient temperature at the hands four inches (102 mm) below the outlet 228 (FIG. 3).

Figure 5:
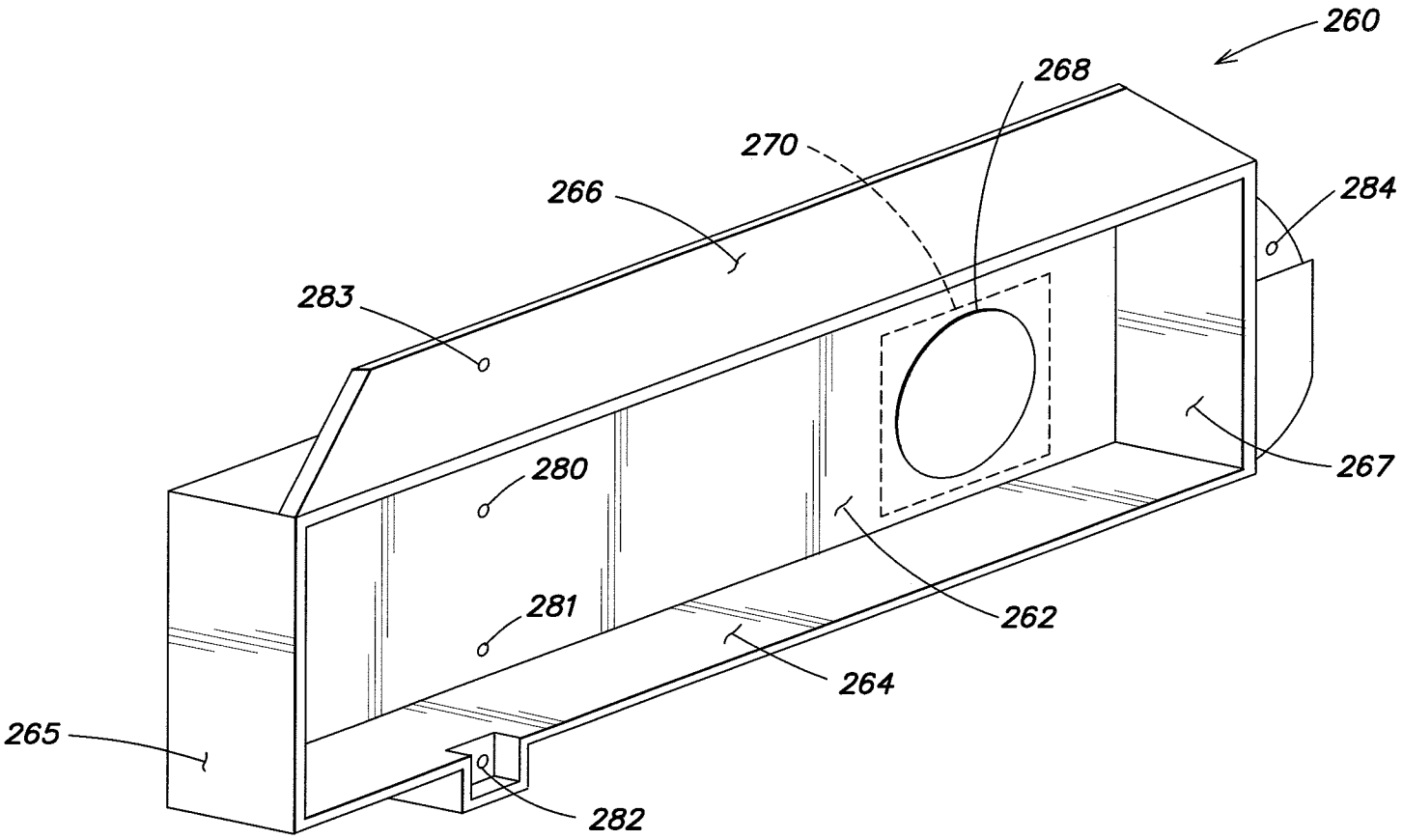
FIG. 5 is a perspective view of an embodiment of the filter housing of the hand dryer illustrated in FIG. 3.

FIG. 5 is a perspective view of a filter housing 260 of the filter assembly 222 illustrated in FIG. 3. The housing 260 includes a base surface 262 and sidewalls 264-267, whose bottom surfaces are attached the base surface 262. The base surface 262 includes an opening 268 therein that coaxially registers with the impellor air inlet 250 (FIG. 4). A gasket 270 may be provided on the backside of the base surface 262 surrounding the opening 268 to ensure that air entering the impellor air inlet 250 (FIG. 4) first flows through the filter (to be discussed herein below) and the opening 268 to provide a sealed HEPA filter system (also often referred to as a true HEPA filter). The back surface 262 includes bores 280-281 that allow the controller 232 (FIG. 3) to be attached to the back the housing 260 using several fasteners. Bores 282-284 facilitate securing the housing by aligning the bores 282-284 with the threaded bores 248, 247 and 247, respectively (FIG. 4).

Figure 6:
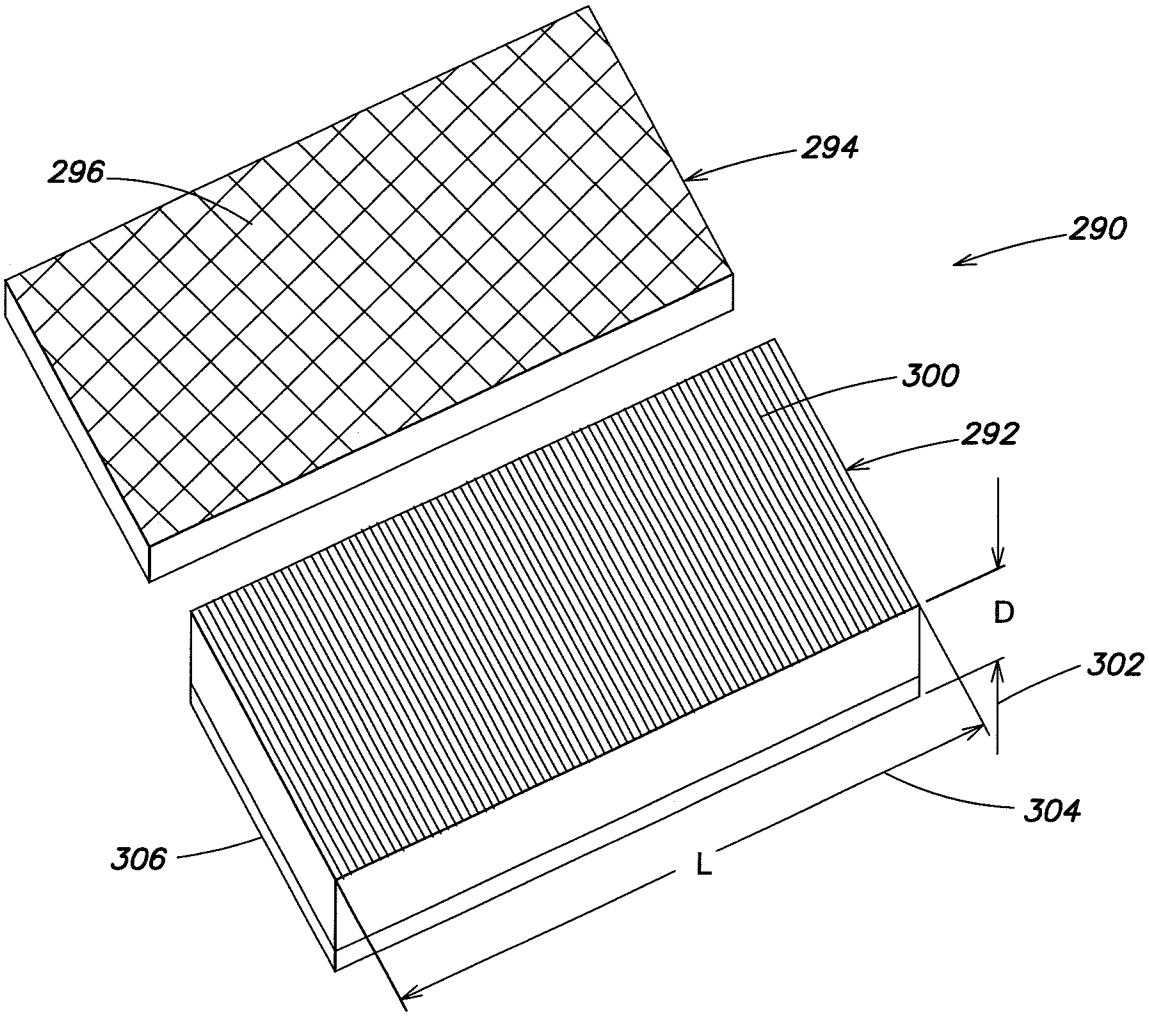
FIG. 6 is a perspective view of a removable and replaceable filter assembly having a pre-filter cover assembly and a main filter assembly.

FIG. 6 is a perspective view of a removable and replaceable air filter 290 having a main filter assembly 292 and a pre-filter cover assembly 294 removed from the main filter assembly 292. The pre-filter cover assembly 294 is operably positioned atop the main filter assembly 292. The pre-filter cover assembly 294 includes a coarse filter 296 through which air is drawn by the blower motor assembly. Air passing through the coarse filter 296 is then filtered by a finer filter material 300, preferably configured for example as a high-efficiency particulate air (HEPA) filter. In one embodiment, the HEPA filter may be arranged to have a depth D 302 (e.g., about three inches) and have about nine pleats per inch extending along a lengthwise axis L 304 of the filter. In one embodiment the main filter assembly is about 9" long (23 cm), about 4" wide (10 cm) and about 3" deep (8 cm). One of ordinary skill will recognize the filter illustrated in FIG. 6 is not to scale in the interest of ease of illustration. Of course one of ordinary skill in the art will appreciate that many different filters including HEPA filter embodiments may be employed to remove undesired particles.

Referring to FIGS. 5 and 6, with the cover 294 placed over the main filter assembly 292, the removable and replaceable filter 290 is inserted into the housing 260 (FIG. 5) such that the cover 294 is located on the exterior side of the housing 260. Air entering the filter 290 is drawn through the coarse filter 296, then into the HEPA filter 300 and exits the filter to pass through the opening 268 and into air inlet 250 (FIG. 4). The main filter assembly 292 includes a gasket 306 that is located along the periphery of the four sidewalls to provide a seal to ensure that air entering the opening 268 (FIG. 5) first passes through the filter 290, to provide a sealed HEPA. The sidewalls 264-267 (FIG. 5) of the housing 260 may be slightly tapered to provide a good seal with the gasket 306 (FIG. 5). Conversely, the sidewalls of the removable and replaceable filter 290 may be tapered to facilitate insertion to the housing, and a seal between the gasket 306 and the sidewalls 264-267 of the housing 260.

Figure 7:
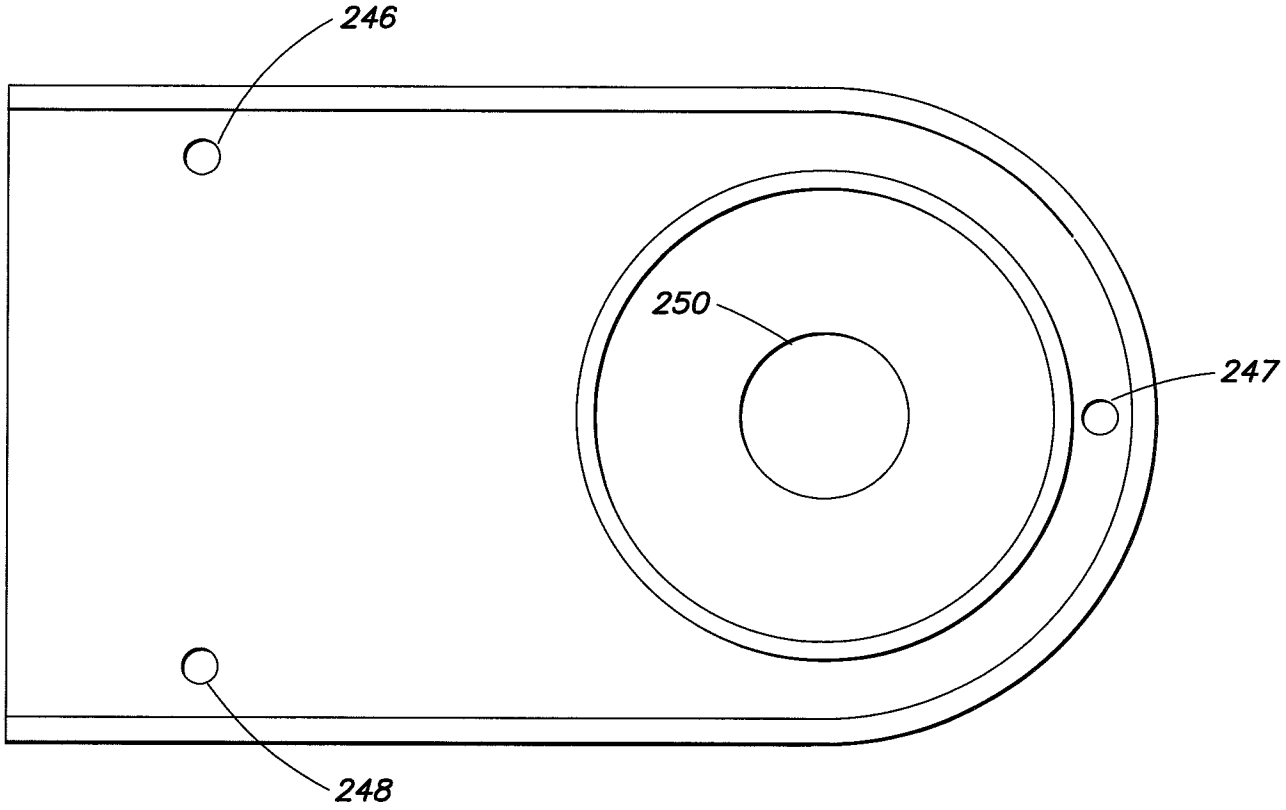
FIG. 7 is a right side view of the hand dryer illustrated in FIG. 3.

FIG. 7 is a right side view of the hand dryer illustrated in FIG. 3. The gasket 270 (FIG. 5) seals around the opening 250, and the housing 260 (FIG. 5) is secured to the assembly 218 via the threaded bores 246-248.

Figure 8:
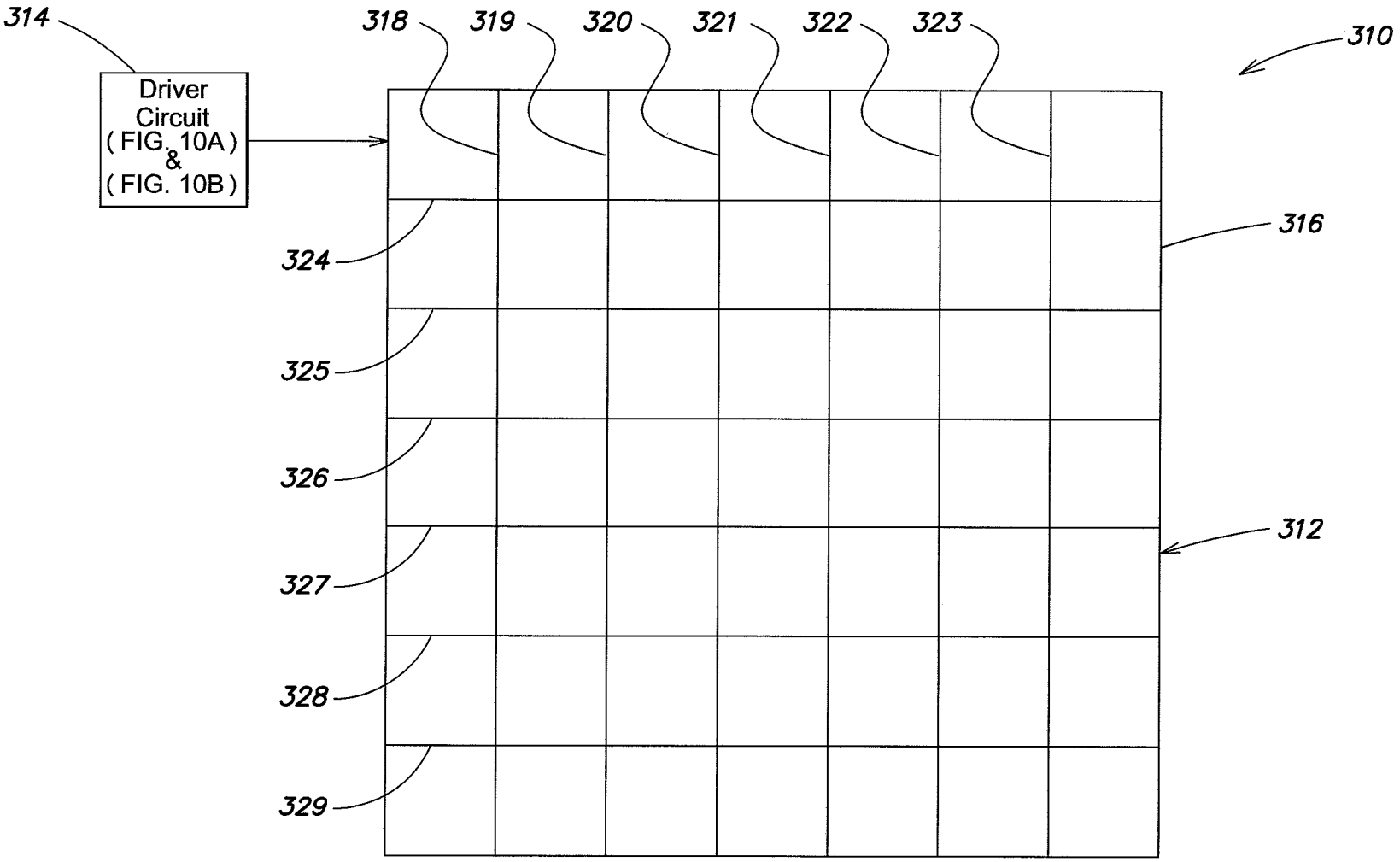
FIG. 8 is an illustration of an ion generator that is a component of the hand dryer illustrated in FIG. 3.

FIG. 8 is an illustration of an ion generator 310 that includes an ion generator assembly 312 and drive electronics 314. The ion generator assembly includes an insulating frame 316 and a grid of wires comprising a plurality of ground wires 318-323 and a plurality of corona wires 324-329 (e.g., 0.002 diameter tungsten wire) that provide a negative electrode. The air passes substantially perpendicularly through the grid picking up ions on the way. The ground grid is positioned just after the heater coils 252 (FIG. 4) in the air path with the high voltage grid positioned approximately 0.3" from the ground grid. One of ordinary skill in the art will recognize that various ion generator configurations may be used to assist in providing sanitized air, such as for example Log 3 sanitized air.

Figure 9:
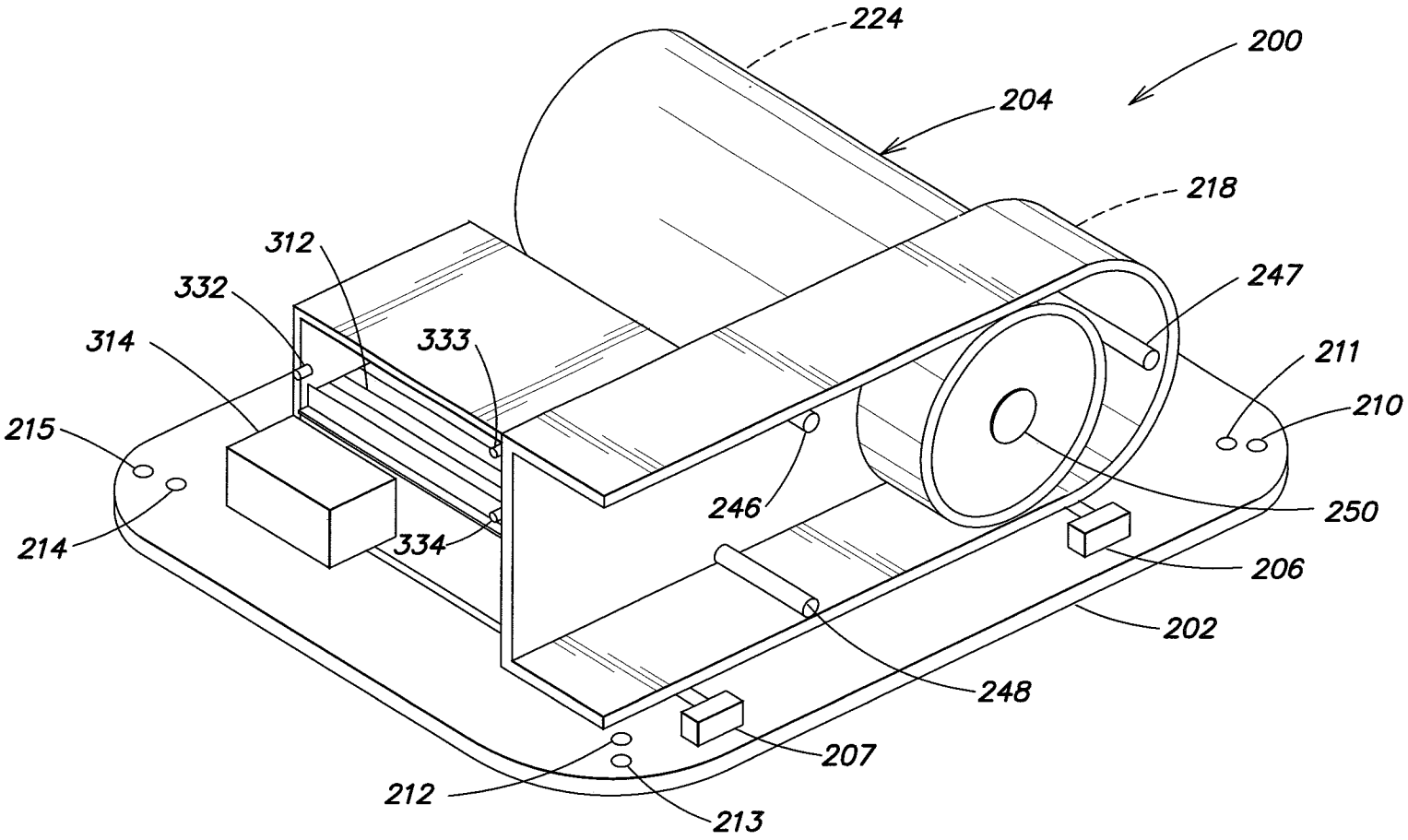
FIG. 9 illustrates the ion generator configured and arranged in an outlet airflow path of the sanitizing hand dryer illustrated in FIG. 3.

FIG. 9 illustrates the ion generator configured and arranged in an outlet airflow path of the sanitizing hand dryer illustrated in FIG. 3. FIG. 9 is substantially the same as FIG. 4, but FIG. 9 illustrates the ion generator assembly 310 operably positioned above (i.e., downstream of) the heating coils 252 (FIG. 4). Referring to FIG. 9, the ion generator grid assembly 312 is positioned in the outlet flow path operably connected to its drive electronics 314. The ion generator assembly 310 may be secured to the blower motor housing assembly 218 along with the nozzle discharge assembly 226 (FIG. 3), for example removably and replaceably via a plurality of threaded fasteners and threaded bores 332-334. The insulating frame 316 of the ion generator assembly includes a front surface 336 that extends above the grid of wires within the ion generator to protect the grid of wires from foreign objects being inserted into the outlet 228 (FIG. 3) of the nozzle discharge assembly 226 (FIG. 3). The circuit board of the generator grid assembly 312 may include an exposed ground plane that contacts the plastic housing of the hand dryer to bleed off electrical charge that can build up on the plastic housing.

In one embodiment the ion density produced in the output air stream may be about 2 million negative ions per cc, for example by measuring the ion density at a distance of 10 feet from the unit to avoid measurement errors due to the air speed. At this distance when a 1.1 inch diameter output nozzle on the discharge assembly 226 is used, temperature and velocity measurements may indicate that the output air is diluted by a factor of 20 to 25. Thus measured ion density at this location may be about 80,000 to 100,000 negative ions per cc, which corresponds to 2 million ions per cc at the nozzle.

With the 1.1 inch nozzle, the dryer may produce about 1.5 cubic feet (42,500 cc) of air per second. At this rate, this unit produces approximately 85 billion negative ions per second, or 1.3 trillion ions in a 15 second use. If the dryer is operated in a room that is 8×8×8 feet, this output is sufficient to provide nearly 90,000 negative ions per cc over the volume of the room. The ions will gradually dissipate over several minutes if the unit is not operated again. Significant sanitizing benefits and a reduction of disease transmission result negative ion concentrations of approximately 2,000 ions per cc.

Figure 10A:
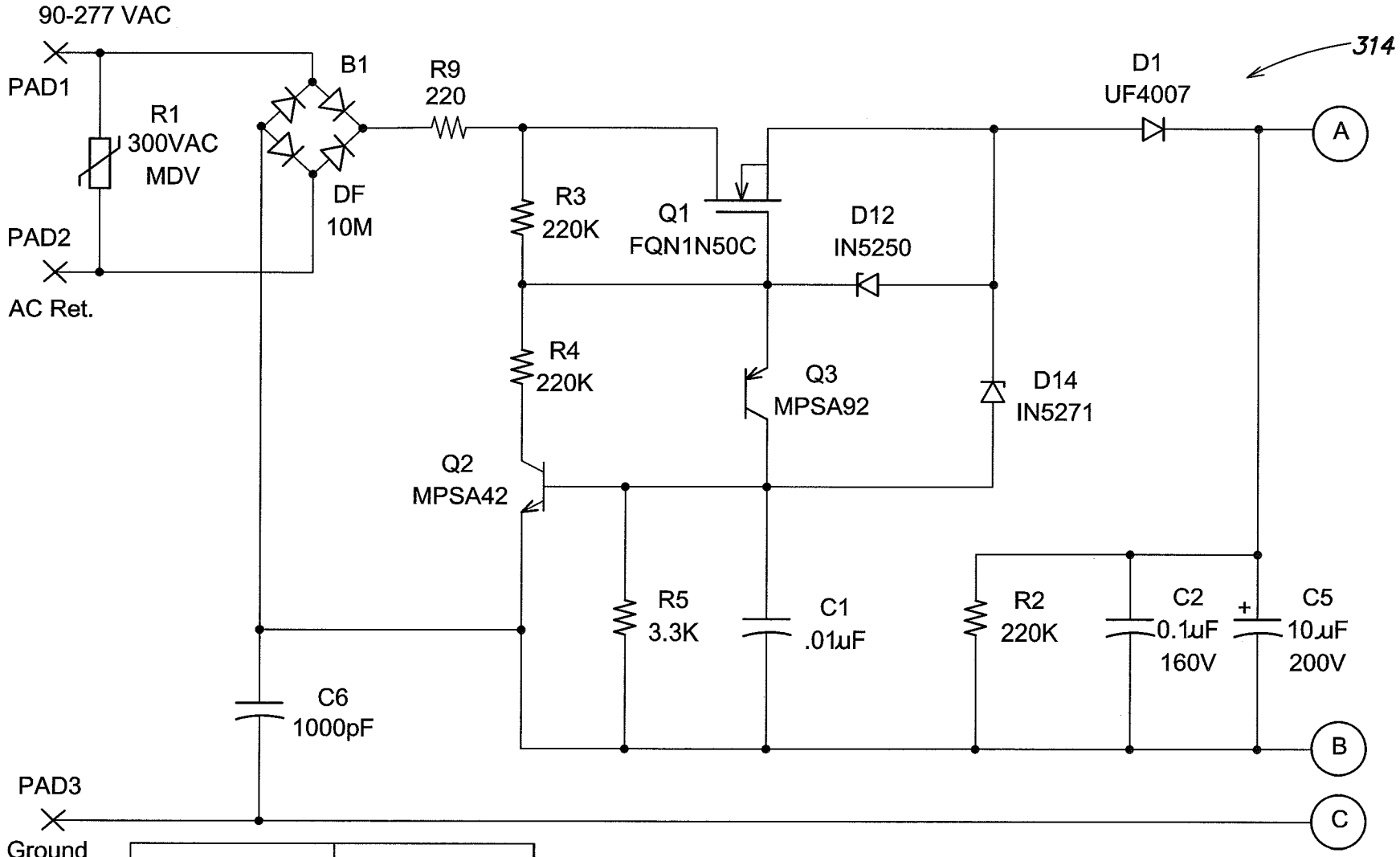
FIGS. 10A and 10B collectively are is a schematic illustration of an embodiment of the ion generator driver circuit.
Figure 10B:
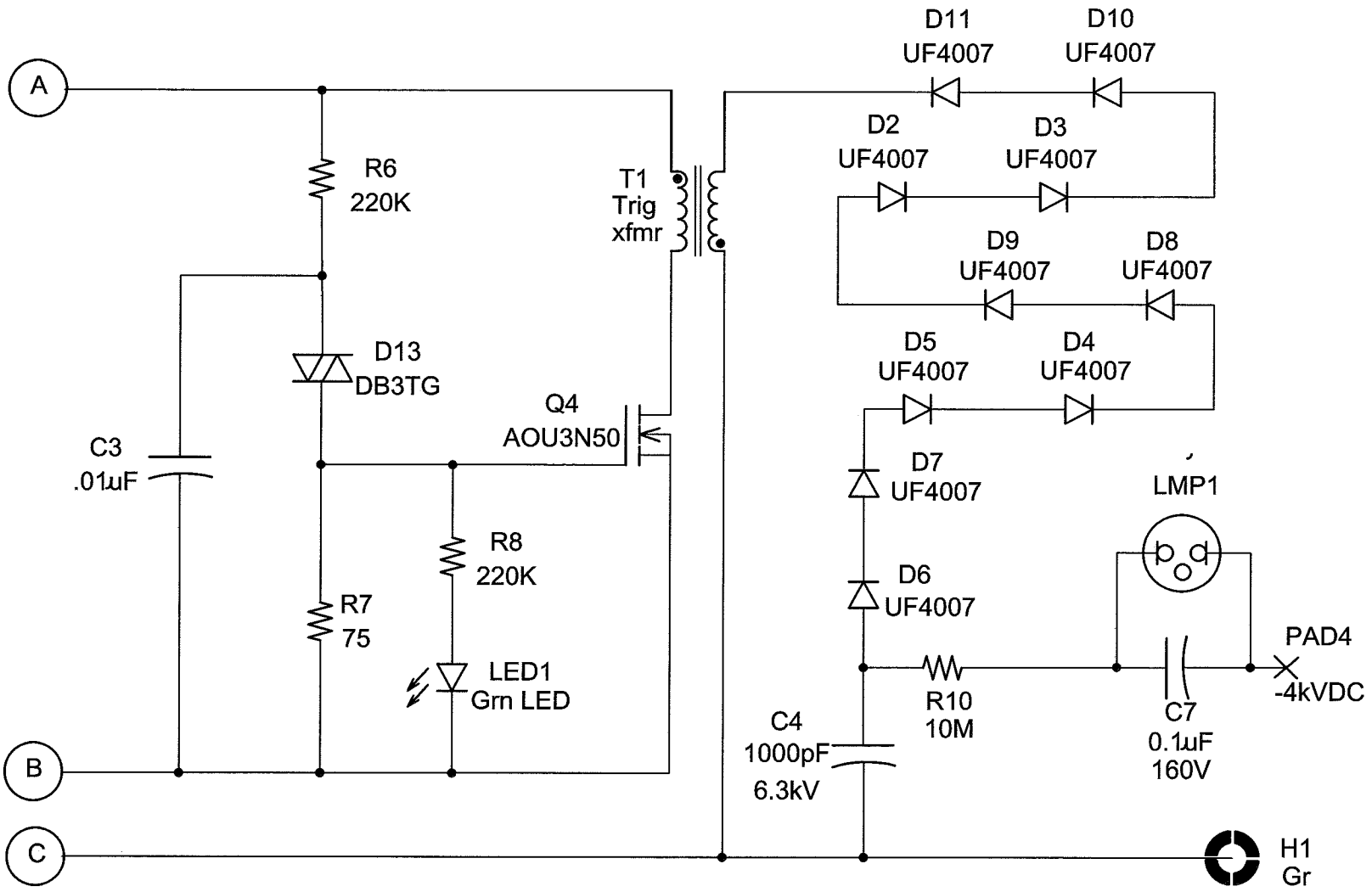

FIGS. 10A and 10B schematically illustrate an embodiment of the driver circuit 314. The circuit may receive input power of about 90 to 305V AC to a DC voltage of approximately 100V. The 100V DC powers a 2 kHz diac oscillator that provides one microsecond pulses to a FET that drives a xenon flash trigger transformer. This transformer isolates the output from the AC line and provides 4 to 4.5 kV pulses that are rectified and filtered to drive the corona wires.

The AC line input to this circuit includes a transient absorber (R1) to reduce the likelihood of damage to this circuit by external voltage spikes. The line voltage is then rectified through a full wave bridge to produce pulsing DC with an amplitude of approximately 125V to 425V depending on the input voltage. Current from this DC voltage passes through the FET Q1 and diode D1 to charge filter capacitor C5. When the voltage on C5 reaches approximately 100V, current passes through zener diode D14 which triggers the Schmitt trigger made by transistors Q2, Q3, and resistors R4, and R5. When the Schmitt trigger activates, it turns off Q1 to prevent further charging of capacitor C5. At the end of each pulse in the DC input power, the Schmitt trigger resets to allow topping-off C5 on the next pulse of DC. As a result, current is conducted to the filter capacitor only when the voltage of the input waveform is just slightly more than the capacitor voltage to reduce power dissipation.

Resistor R9 limits the peak current flow into the filter capacitor. This reduces the power dissipation in transistor Q1 and reduces the maximum RMS current in the filter capacitor C5. Resistor R3 provides the bias voltage to turn on the transistor Q1. Diodes D1 and D12 protect transistor Q1 from excessive gate voltages. Capacitor C1 reduces false triggering of the Schmitt trigger from the noise pulses generated by the oscillator and power driver. Capacitor C2 is a high frequency bypass capacitor for the 100V power, and resistor R2 discharges the filter capacitors when power is removed for safety. Capacitor C6 provides electrical noise bypass to ground.

The 2 kHz pulses are created with a relaxation oscillator formed by diac components D13, C3, R6 and R7. Capacitor C3 is charged from the 100V through resistor R6. When the voltage on capacitor C3 reaches the breakdown voltage of the diac D13 (approximately 32V), it is discharged by the diac. The discharge current flows through resistor R7 creating a voltage pulse of approximately 10 V peak and with a width of about 1 microsecond. This pulse is directly applied to the gate of the power FET Q4 which creates a 1 microsecond current pulse through the primary of the trigger transformer T1. This generates a high voltage pulse of 4 to 4.5 kV on the output of the trigger transformer. This pulse is rectified, for example by ten 1 kV high speed diodes in series (a single 10 kV diode may be used). Capacitor C4 filters the high voltage to provide a constant DC voltage output.

LED1 is a high output green LED that acts as a power-on indicator. It also indicates that the 100V power supply and the oscillator portions of the circuit are operating. The LED is driven through resistor R8 from the 10V pulses because this is the only low voltage in the circuit that can efficiently drive the LED, no matter what the input voltage is. Resistor R10 is placed in series with the high voltage output for safety to prevent electrical shocks if the corona wires are touched. Capacitor C7 and the lamp LMP1 form the flashing indicator to verify proper operation of the high voltage circuit and the corona wires. A few microamps of current normally flow to the corona wires when the unit is operating properly. This current charges capacitor C7 until it reaches the breakdown voltage of lamp LMP1. The lamp then flashes, partially discharging capacitor C7, which then charges back up. The amount of current flow to the corona wires determines the rate of flashing. If the corona wires are shorted to ground, the corona current will be much higher and the lamp will flash very rapidly and may appear to be on continuously. If the lamp flashes very slowly or not at all it is an indication that too little current is flowing, which may be due to an open connection to the corona wires, or a failure in the high voltage circuit.

One of ordinary skill will of course immediately recognize that the embodiment of FIGS. 10A and 10B is one of many different driver circuit embodiments that may be used to generator ions in a sanitizing hand dryer. An example of components and values illustrated in the circuit of FIGS. 10A and 10B is provided in Table 1 set forth below.

TABLE 1

| Reference | Value |
|---|---|
| B1 | DF10M |
| C1, C3 | .01 uF ceramic |
| C2 | 0.1 uF 160 V film |
| C4 | 1000 pF 6.3 KV ceramic |
| C5 | 10 uF 160 V AI. 105 deg. |
| C6 | 1000 pF 300 VAC Safety |
| C7 | 0.1 uF 160 V film |
| D1-D11 | UF4007 |
| D12 | 1N5250 |
| D13 | DB3TG Diac |
| D14 | 1N5271 |
| LED1 | C4SMF-GJS-CV0Y0792 Grn LED |
| LMP1 | Neon Lamp |
| Q1 | FQ1N50C; 500 V, TO-92 FET |
| Q2 | MPSA42 |
| Q3 | MPSA92 |
| Q4 | AOU3N50 |
| R1 | 300 VAC Varistor (MOV) |
| R2-R4, R6 | 220K |
| R5 | 3.3K |
| R5 | 100K |
| R7 | 75 ohm |
| R8 | 220 ohm |
| R10 | 10M |
| T1 | ZS 1052 |

In one embodiment the dryer may be based upon the proven reliability of an XLERATOR® hand dryer available from the assignee of the present invention, Excel Dryer, Inc. (www.exceldryer.com), but modified include an input filter assembly and an ion generator. Excel Dryer, Inc. is also the assignee of U.S. Pat. Nos. 6,038,786 and 7,039,301, both of which are hereby incorporated by reference.

Although the hand dryer has been discussed in the context of a single exit nozzle that provides the forced air to dry the hands of a user, it is contemplated that the dryer may have a plurality of exit nozzles. The plurality of nozzles may be spaced apart and arranged so as to provide forced hot air to dry both hands of a user simultaneously. While the hand dryer has been discussed in the context of a preferred embodiment of an automatic hand dryer that senses the proximate hands of a user and turns on, it is of course contemplated that embodiments may include hand dryers that are turned on manually by the user.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A sanitizing hand dryer, comprising:

a dryer housing having an air inlet that includes an inlet air sanitizer within the air inlet, and having an exit nozzle;

an air filter assembly having a coarse filter and a high-efficiency particulate air (HEPA) filter that receives air from the air inlet and provides filtered air, wherein the air filter assembly comprises a filter housing within the dryer housing, and that comprises inwardly tapered parallel sidewalls each having a respective bottom surface that is attached to back surface to form a chamber that receives a removable and replaceable filter cartridge that comprises the coarse filter and the high-efficiency particulate air filter, and a first gasket on an exterior surface of the air filter assembly to seal against adjacent sidewall surfaces of the filter housing;

a blower that draws filtered air and accelerates that filtered air to provide high speed filtered air; and an ion generator, located downstream of the blower, where the ion generator includes a wire grid through which the filtered air passes to provide sanitized air to the exit nozzle, wherein the back surface of the filter housing includes an opening therein through which the filtered air passes to the blower, wherein an exterior surface of the back surface surrounding the opening includes a second gasket that forms a seal between the filter housing and the blower so substantially only filtered air enters the blower while the blower is operating.

2. The apparatus of claim 1, further comprising a heater that is positioned downstream of the blower and upstream of the ion generator along a flow path of the high speed filtered air to heat the high speed filtered air.

3. The apparatus of claim 1 wherein the exit nozzle is shaped in such a manner that the air is blown with sufficient force to knock moisture off skin of a user.

4. The apparatus of claim 1, further comprising a sensor that automatically turns on the blower and the ion generator when the hands of a user are detected immediately below the exit nozzle.

5. The apparatus of claim 1, further comprising a convective heating element located upstream of the ion generator and downstream of the blower to heat the high speed filtered air.

6. The apparatus of claim 1, where the inlet air sanitizer is selected from at least one of an ozone generator, a sanitizing light source, an ultraviolet light bulb, a photocatalytic oxidation system, an inlet ion generator, and an electrostatic precipitator.

7. A sanitizing hand dryer, comprising:

a dryer housing having an air inlet that includes an air sanitizer, and having an exit nozzle that is perpendicular to an axial direction of the air inlet;

a filter housing that is secured within the dryer housing about the air inlet;

an air filter assembly that seats with a friction fit within the filter housing, wherein the air filter assembly comprises a coarse filter and a high-efficiency particulate air (HEPA) filter that are serially arranged to receive ambient air and provide filtered air, wherein the filter housing comprises inwardly tapered sidewalls each having a respective bottom surface that is attached to a back surface to form a chamber that receives a removable and replaceable filter cartridge that comprises the coarse filter and the high-efficiency particulate air filter, and a first gasket on an exterior surface of the air filter assembly to seal against adjacent sidewall surfaces of the filter housing;

a blower that draws the filtered air and accelerates the filtered air to provide high speed filtered air; and an ion generator located downstream of the blower, where the ion generator includes a high voltage wire grid through which the high speed filtered air passes to provide high speed sanitized air to the exit nozzle, wherein the back surface of the filter housing includes an opening therein through which the filtered air passes to the blower, wherein an exterior surface of the back surface surrounding the opening includes a second gasket that forms a seal between the filter housing and the blower so substantially only filtered air enters the blower while the blower is operating.

8. The sanitizing hand dryer of claim 7, further comprising a heater that is positioned downstream of the blower and upstream of the ion generator along a flow path of the high speed filtered air to heat the high speed filtered air.

9. The sanitizing hand dryer of claim 7, wherein the exit nozzle is shaped in such a manner that the air is blown with sufficient force to knock moisture off skin of a user.

10. The sanitizing hand dryer of claim 7, further comprising a sensor that automatically turns on the blower and the ion generator when the hands of a user are detected immediately below the exit nozzle.

11. The sanitizing hand dryer of claim 7, further comprising a convective heating element located upstream of the ion generator and downstream of the blower to heat the high speed filtered air.

12. The sanitizing hand dryer of claim 7, where the inlet air sanitizer is selected from at least one of an ozone generator, a sanitizing light source, an ultraviolet light bulb, a photocatalytic oxidation system, an inlet ion generator, and an electrostatic precipitator.

* * * * *